US007082621B1

(12) United States Patent
Fratesi

(10) Patent No.: US 7,082,621 B1
(45) Date of Patent: Aug. 1, 2006

(54) THIGH PAD PROTECTORS

(76) Inventor: Gary R. Fratesi, 7922 E. Cochise Dr., Scottsdale, AZ (US) 85258

( * ) Notice: Subject to any disclaimer, the term of this patent is extended or adjusted under 35 U.S.C. 154(b) by 0 days.

(21) Appl. No.: 11/223,766

(22) Filed: Sep. 9, 2005

(51) Int. Cl.
*A41D 1/06* (2006.01)

(52) U.S. Cl. ..... 2/227

(58) Field of Classification Search ..... 2/79, 2/227, 69, 455, 23, 24, 456, 911
See application file for complete search history.

(56) References Cited

U.S. PATENT DOCUMENTS

| | | | | |
|---|---|---|---|---|
| 1,659,100 | A | 2/1928 | Hardage | 2/23 |
| 1,669,085 | A | 5/1928 | Guyon | 2/23 |
| 1,744,384 | A | 1/1930 | Hood | |
| 1,767,372 | A | 6/1930 | King | 2/22 |
| 1,772,923 | A | 8/1930 | Volz | 2/22 |
| 1,784,148 | A | 12/1930 | Levinson | 2/2 |
| 1,991,721 | A | 2/1935 | Becket et al. | 2/2 |
| 2,609,537 | A | 9/1952 | Pfaff | 2/22 |
| 2,785,407 | A | 3/1957 | Reeder | |
| 2,818,571 | A | 1/1958 | Grant | |
| 3,044,075 | A | 7/1962 | Rawlings | |
| 3,909,847 | A | 10/1975 | Holt | |
| 4,024,584 | A | 5/1977 | Smith | 2/24 |
| 4,455,686 | A | 6/1984 | Zide | |
| D280,145 | S | 8/1985 | Vacanti | |
| 5,005,565 | A | 4/1991 | Fratesi | |
| 5,107,823 | A | 4/1992 | Fratesi | |
| 5,168,576 | A | 12/1992 | Krent et al. | |
| 5,551,082 | A | 9/1996 | Steward et al. | |
| 6,161,222 | A * | 12/2000 | Strickland et al. | 2/228 |
| 6,282,724 | B1 | 9/2001 | Abraham et al. | |
| 6,532,599 | B1 | 3/2003 | Dugan | |

* cited by examiner

*Primary Examiner*—Tejash Patel
(74) *Attorney, Agent, or Firm*—Tod R. Nissle, P.C.

(57) ABSTRACT

A thigh pad protector that includes superiorly connected and individually ventilated pad protectors for the anterior (front) and lateral (side) of the thigh. The anterior thigh protector portion is constructed to fit into an inside pocket in the garment normally worn outside the protector (such as a pair of football pants or athletic girdle). The fixation of the anterior thigh protector portion within the inside pocket of the garment provides support to both the anterior thigh protector portion and the superiorly connected lateral thigh protector portion about the thigh. The fact that the two distinct thigh protectors are connected only at their superior (upper) ends allows the protectors to conform to the natural curvature of the thighs with normal garment compression and to remain in conformity with the legs through the full range of muscular motion (contraction and relaxation) without constriction or decreased mobility.

5 Claims, 8 Drawing Sheets

THIGH PAD PROTECTORS

BACKGROUND OF THE INVENTION

Football players are particularly susceptible to injury in the area of the lateral (outside portion) of the thigh which is currently unprotected with the accepted standard configuration of current leg pads as stated by the published rules of the official governing bodies at all levels of football. In accordance with these rules, the typical uniform trousers or athletic girdles for athletes provide pockets in the garments for receiving pads to protect the anterior (front portion) of the thigh only. While present day anterior thigh pads provide adequate protection to that particular area of the thigh, they offer no protection from blows to the outside or lateral thigh region.

The present invention seeks to extend protection to the lateral (outside) portion of the thigh without necessitating modifications to the inside thigh pad pockets of existing uniform trousers or athletic girdles or requiring newly manufactured trousers or athletic girdles with a new configuration of pockets while bringing improved ventilation to the anterior thighs.

In addition, the present invention is designed to readily conform to the unique anatomical contours of individual thighs from the front to the outside region with normal garment compression and to allow these thigh pad protectors to remain in conformity with the legs through the full range of muscular motion (contraction and relaxation) without constriction or decreased mobility.

As separate protective devices thigh pads of one kind or another have been proposed, and some prior art configurations are depicted in the following prior art patents:

U.S. Pat. No. 6,532,599 issued in 2003 to Dugan, and

U.S. Pat. No. 5,551,082 issued in 1996 to Steward et al.

These prior art thigh pads required a separately manufactured athletic girdle and are not intended for use with the existing interior pocket configuration of standard football uniform trousers and athletic girdles. Nor are these devices suited for use with the existing configuration of standard and mandatory by rule football thigh protective equipment.

The prior art does include thigh pads specifically suggested for football with U.S. Pat. No. 4,455,686 to Zide being typical, but here there is no suggestion of how such a protector can be incorporated with or used in conjunction with present day football uniform trousers and/or athletic girdles in general without newly manufactured uniform pants or the modification of existing pants to properly accept the design for this type of protective thigh padding.

My own prior art:

U.S. Pat. No. 5,005,565 issued in 1991 to Fratesi

U.S. Pat. No. 5,107,823 issued in 1992 to Fratesi does include some means of lateral thigh protection, but the device described is supported by a separate movable locator plate, the focus of which is to rotationally adjust the locator plate in order to position the device in relation to the user's knee to ensure unrestricted knee movement irrespective of the final positioning of the thigh component part. There is also no design feature that that allows the hard thigh shell to expand or contract in order to contour to the user's specific thigh anatomy or to move with in relation to the wearer's thigh through the normal range of thigh expansion and contraction motion. In addition, the significant weight of the constructed referenced devices resulting from their comparatively larger size and heavier materials of construction proved such that it is unsuited for use in existing football uniform trousers or athletic girdles and required the use of a specially designed athletic girdle of sturdier construction and with a belt to add support from the waist in order to function properly.

Also, there was never any suggestion of mesh patterns for ventilation of underlying tissues in any of the molded components or padding.

SUMMARY OF INVENTION

In accordance with the present invention a thigh pad protector is disclosed that is particularly well suited for use with conventional football player garments.

In accordance with the present invention left and right hand protective devices are provided, each with a separated anterior and lateral portions connected only at their superior aspect. The thigh guard includes a rigid plastic core containing mesh for ventilating the underlying thigh portion of the leg and corresponding suitable padding or the like on either side of the core. The configuration of the anterior thigh portion is generally trapezoidal so as to be received in the pocket provided in a typical football pants leg or athletic girdle. No other support is provided for the thigh pad other than this anterior portion avoiding the need for introducing new pockets to existing football trousers and athletic girdles and/or strapping and encircling the thigh with straps which tend to impede the wearer in his use of the device on the field of athletic competition.

The lateral thigh component pad is an extension of the anterior thigh component pad by a common connection across the superior aspect. As such, the entire device shares the plastic core containing a ventilating mesh configuration and suitable padding or the like on either side of the core.

The preferred form for the interior core will incorporate a mesh pattern for ventilation that is sufficiently strong to disperse any blows across the entire core. Preferred padding on either side of the core will be sufficient to conform with the published rules of play at all levels of football while allowing for maximum ventilation and protection.

DETAILED DESCRIPTION OF FIGS. 1–8

Figure 8:
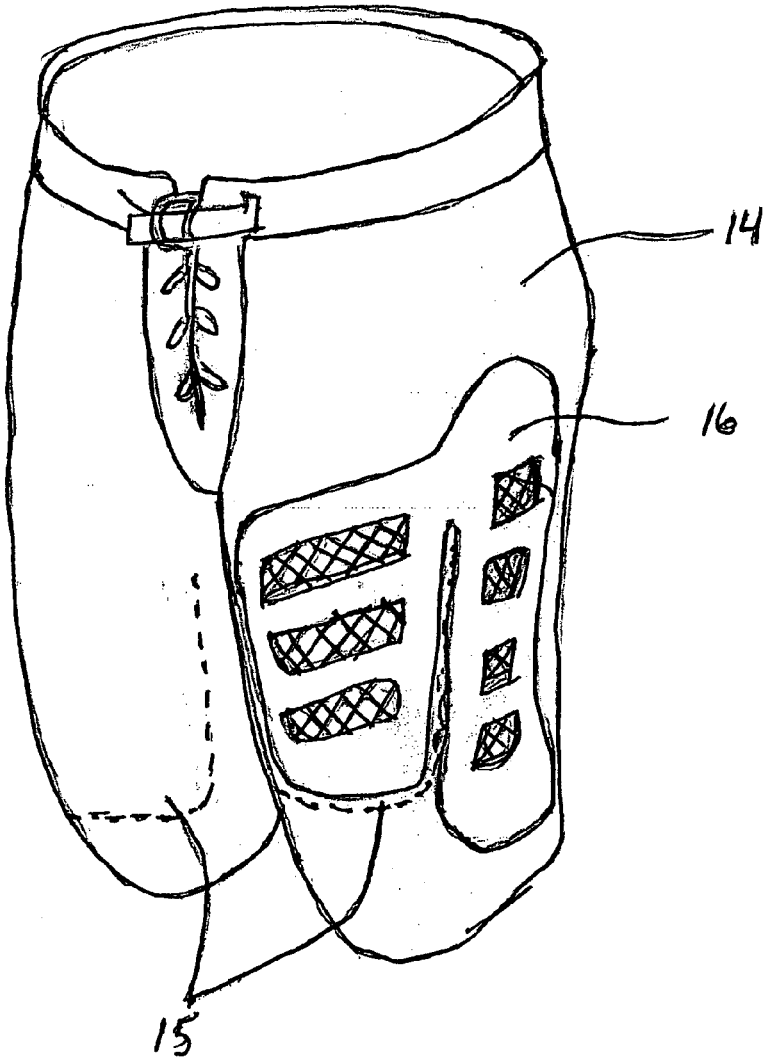
FIG. 8 is a front/side (anterior/lateral) view of a typical football player's uniform trouser showing the device positioned within the typical left thigh pocket provided by the manufacturer to accept traditional mandatory by rule anterior thigh pads.

Referring first to FIG. 8, a conventionally configured pair of football pants 14 is illustrated. The inside thigh pocket 15 of the pants 14 is provided in the usual place on both legs to receive a conventional anterior thigh pad (not shown). The left pocket is utilized to support a device of the present invention. As illustrated in the device of FIGS. 1–5, the anterior component of this device 1 is provided for insertion in this pocket 15 and positioned in direct combination with the uniform trouser 16.

Figure 1:
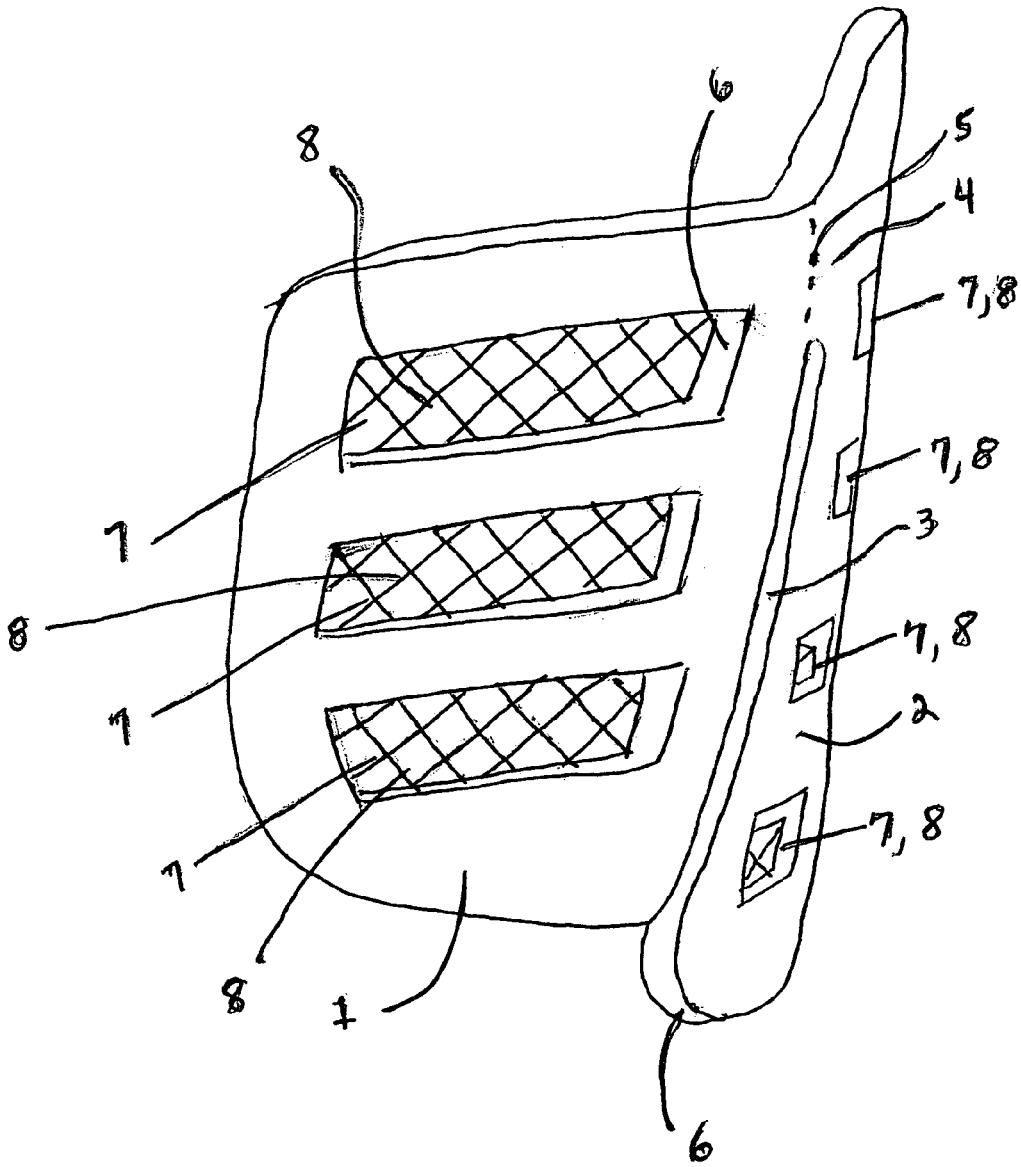
FIG. 1 is a front view of the device showing the anterior thigh pad component and the lateral thigh pad component connected by bridge formed of shared superior (upper) construction components.
Figure 2:
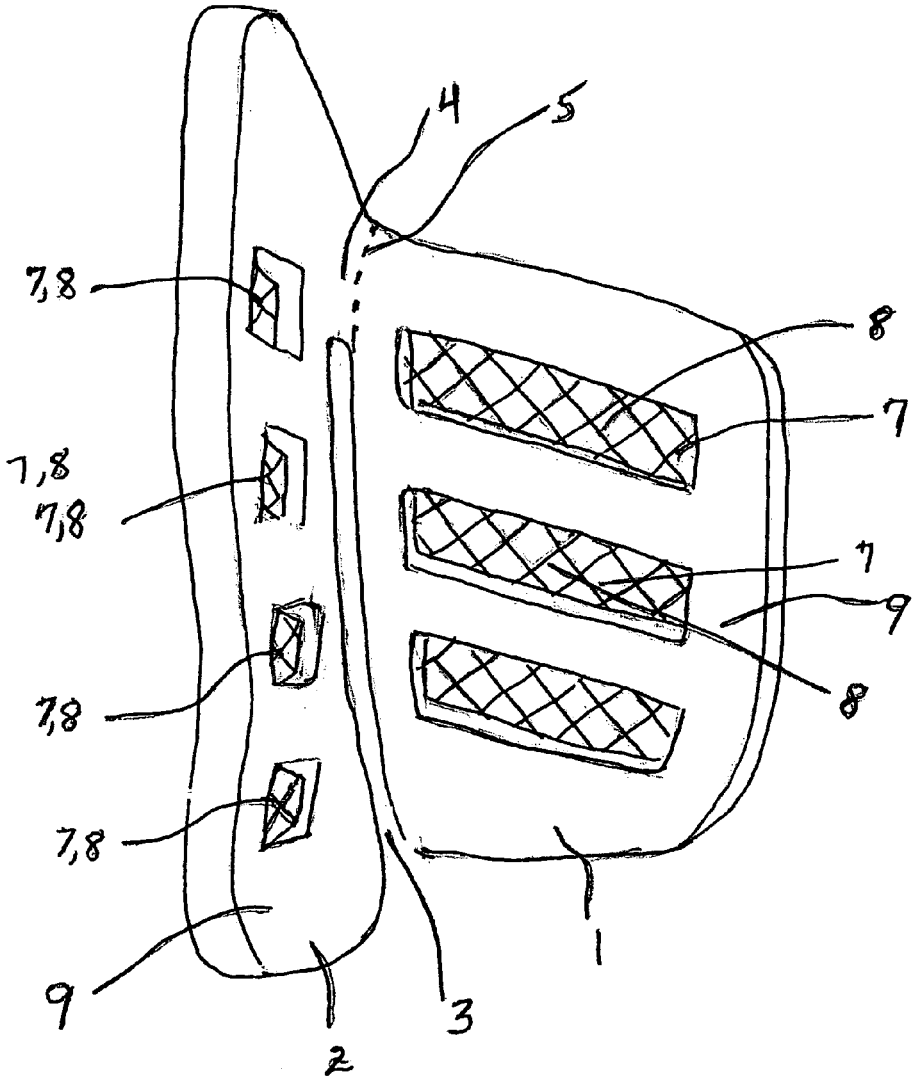
FIG. 2 is a rear view of FIG. 1.
Figure 3:
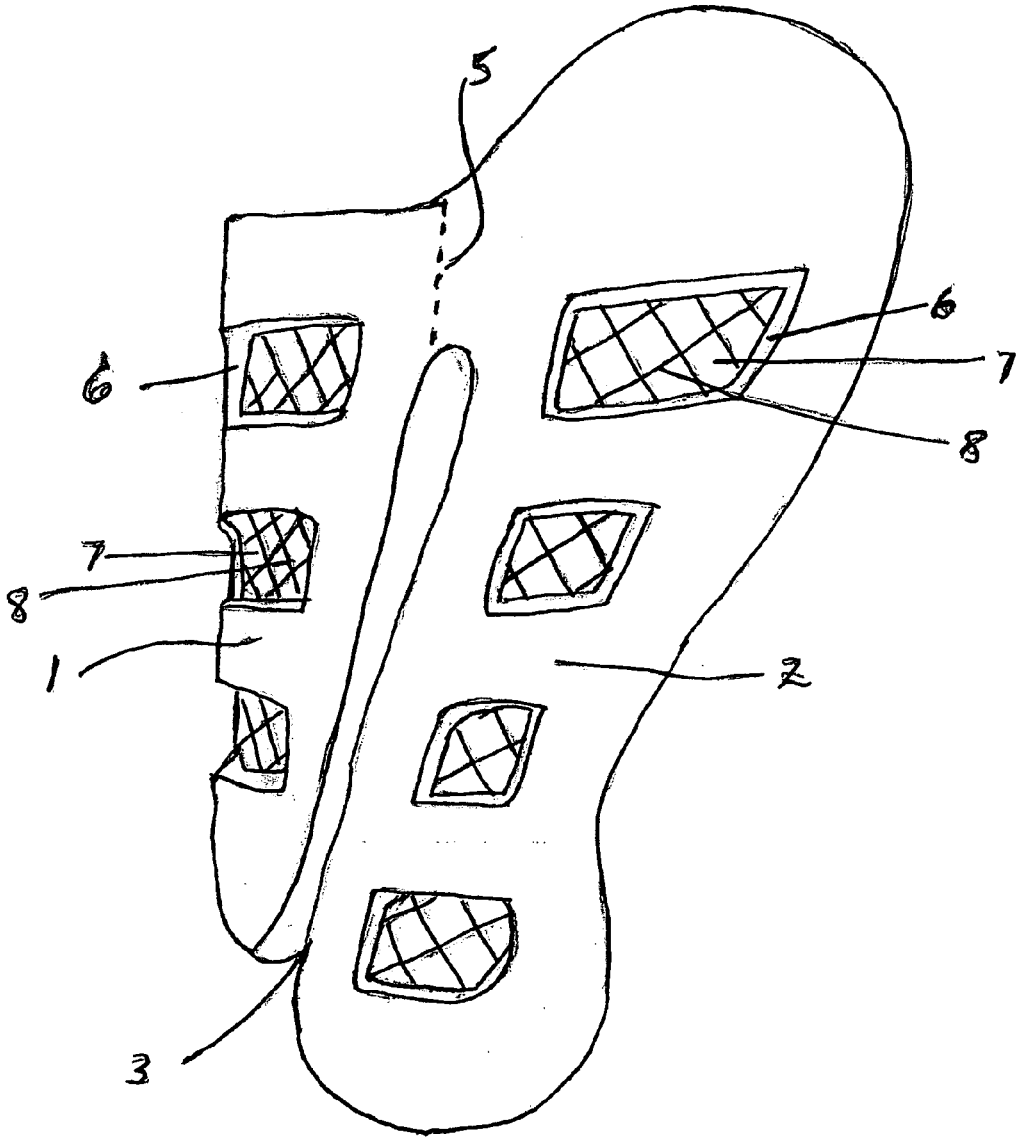
FIG. 3 is a side view of the device illustrated in FIGS. 1 and 2.
Figure 4:
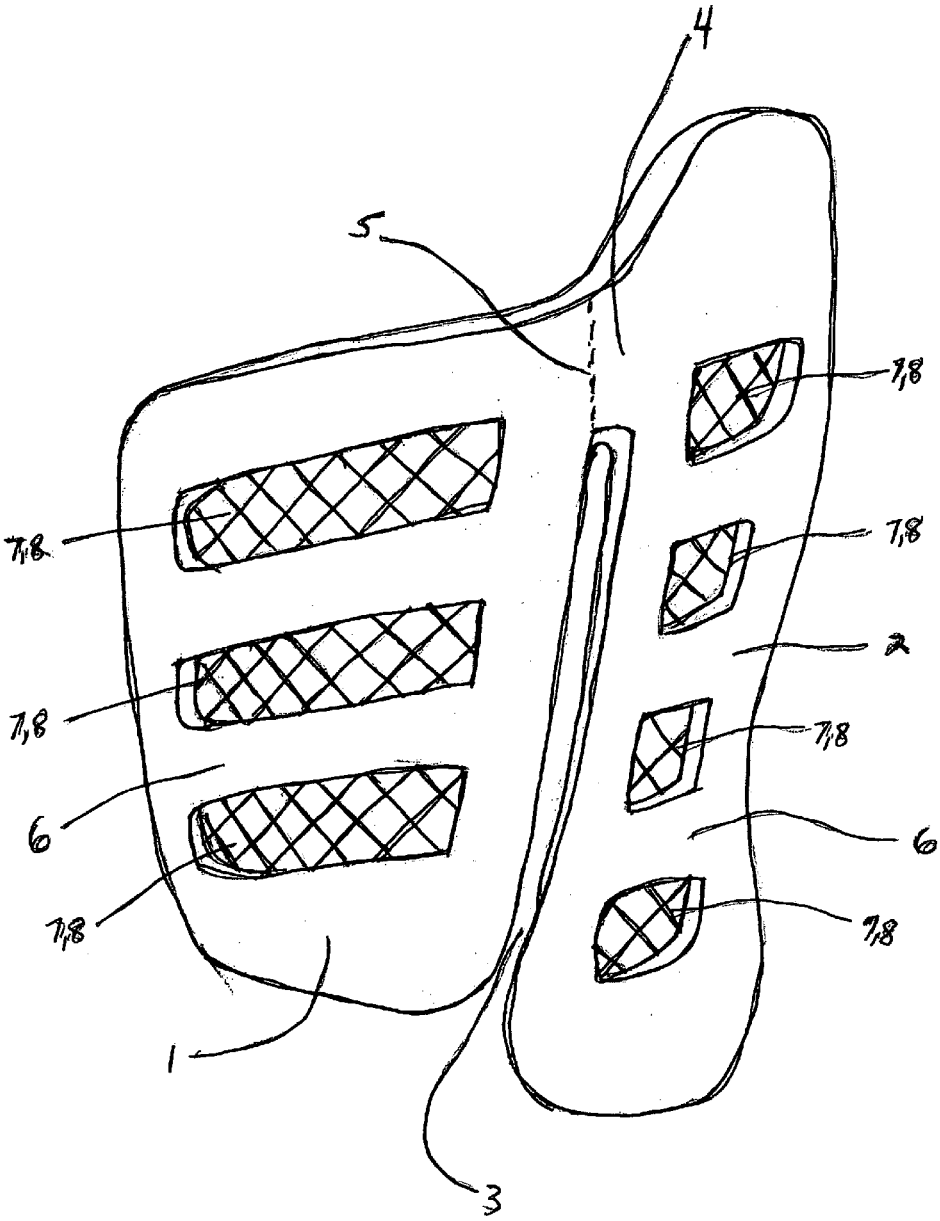
FIG. 4 is a front/side (anterior/lateral) view of the device illustrated in FIGS. 1,2 and 3.
Figure 5:
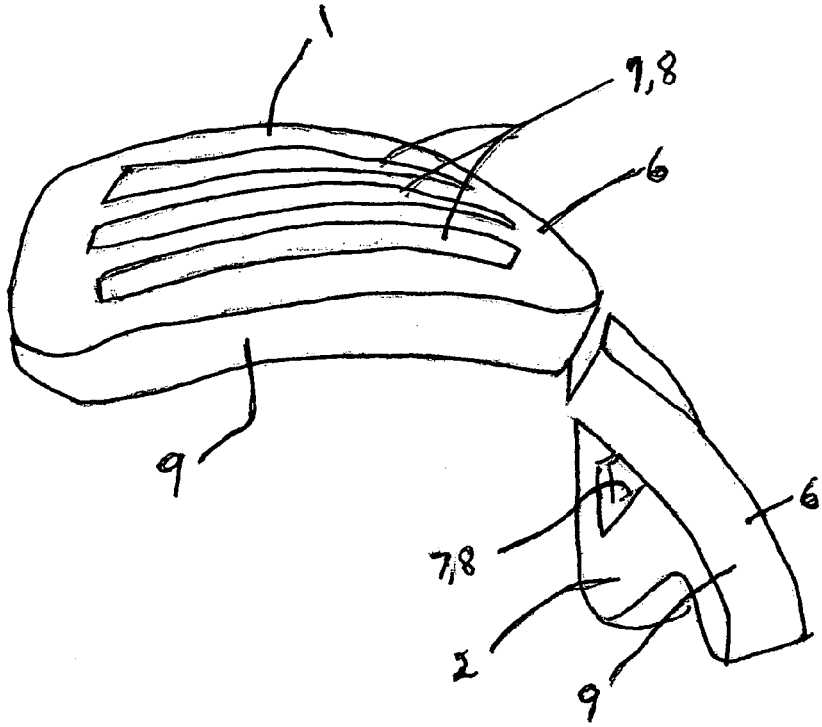
FIG. 5 is a top view of the device illustrated in FIGS. 1,2,3 and 4.

With particular reference to FIG. 1 the anterior component 1 is shaped to fit the left leg of the wearer. Padded portions indicated generally at 6 and 9 extend around the outside and inside of the device respectively to absorb impacts to the front or side of the thigh. At the anterior component 1, at the front of the device, and the lateral component 2, at the side of the device are ventilation openings 7 with plastic core mesh 8 within. The plastic core mesh 8 may be covered on either the outside or the inside with corresponding mesh foam (not shown). A vertically oriented groove 3 separates the anterior component 1 from the lateral component 2 for most of their inferior to superior (down to up) length. The groove 3 terminates at the superior aspect of the common border between the anterior component 1 and the lateral component 2 at which point the anterior component 1 and the lateral component unite 4. A trim line 5 is shown as a continuation of the groove 3 between the anterior component 1 and the lateral component 2 at the superior (upper) end of the device where these two components unite 4. This trim line may be used as a guide to separate the anterior component 1 from the lateral component 2 by usual means if the wearer desires.

Figure 6:
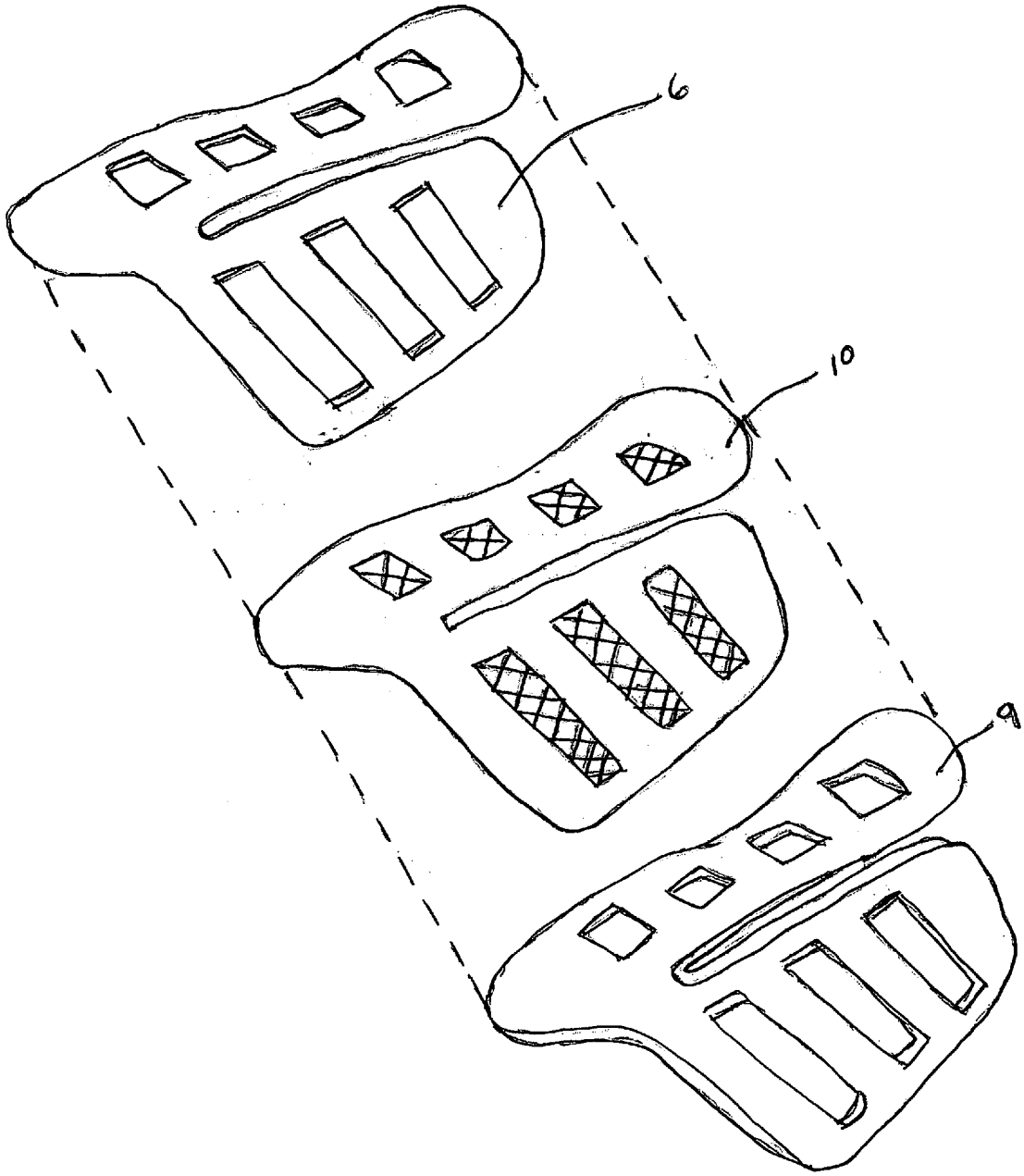
FIG. 6 is a left side horizontal and elevated view of the device shown in FIGS. 1–5 with anterior foam, interior core and posterior foam components separated.

As depicted in FIG. 6, the anterior component 1 and the lateral component 2 share a common plastic core 10 as well as anterior (outside) foam padding 6 and posterior (inside) foam padding 9. The plastic core 10 combines with the anterior (outside) foam layer of padding 6 and inside foam padding layer 9 to absorb blows to the front and sides of the thigh.

In the embodiment of FIGS. 1–5, the anatomical specificity of this device in relation to thigh shape is depicted. The groove space 3 between the anterior component 1 and the lateral component 2 allows the device to conform circumferentially (by expansion or contraction) directly to the wearer's thighs without resistance to this conformation from the area of bridge connection between the anterior component 1 and the lateral component 2 at the superior (upper) end 4 of the device.

Figure 7:
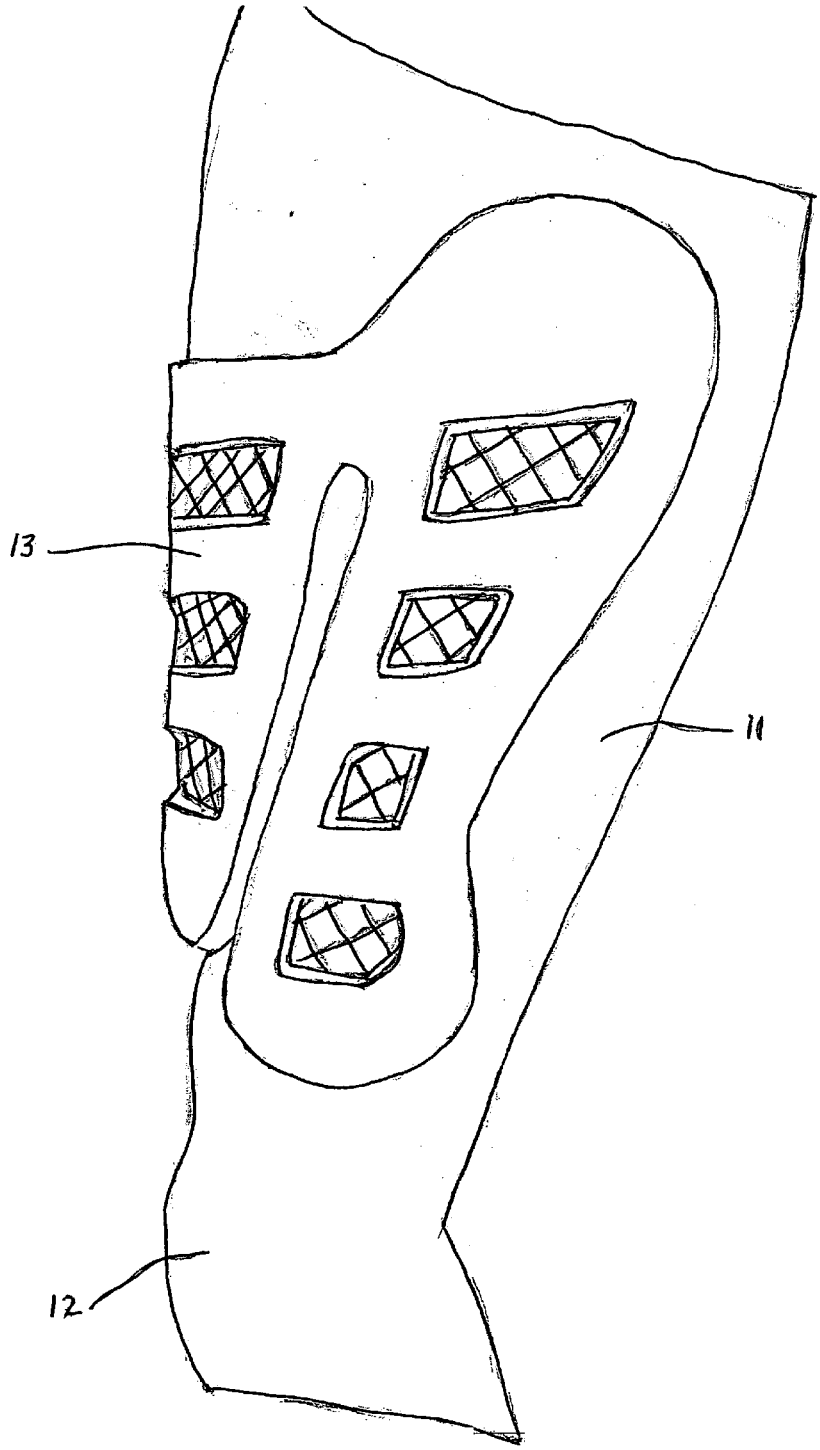
FIG. 7 is a left side view of the device of FIGS. 1–5 with the user's leg shown also.

In the view provided by FIG. 7, the device is shown on the wearer's left leg relative to the thigh 11 and knee 12. This is the preferred protective position for this device on the leg as well as the position achieved by securing the anterior component 1 of this device within the inside thigh pad pocket of an athletic girdle (not shown) and/or the inside thigh pad pocket 15 of a typical pair of football uniform trousers 14 as shown in FIG. 8.

The invention claimed is:

1. A thigh pad protector worn with an article of athletic apparel that defines an anterior inside pocket at the thigh with an upwardly open entry to the pocket (such as a pair of football pants or athletic girdle), with the thigh pad protector used between the wearer's leg and the pocket defining article of apparel, said thigh protector comprising:

(a) a molded plastic core thigh guard covered on each side with either closed or open cell foam appropriately sealed and defining a distinctive anterior (front) portion and a distinctive lateral (side) portion that combine to form an arcuate cross section conforming to the user's thigh, (b) a groove separating said anterior (front) portion and lateral (side) portion through the length of their common border until these two distinct portions join at the superior (upper) aspect of the device with a common core and foam coverings;

(c) an anterior (front) portion contoured to the natural curvature of the thigh that fits securely within an inside thigh pad pocket in a garment normally worn outside the protector (such as a pair of football pants or athletic girdle), (d) a lateral (side) portion that extends superiorly to a position just below typically located garment hip pad pockets and inferiorly to just above the knee with a configuration and a lateral (outside) border contoured to the anatomical curvature of the thigh.

2. In combination with claim 1 said anatomically specific plastic core is fabricated from a high impact plastic such as ABS or the equivalent, defined by normal thigh contours and flexible at the superior (upper) connection between the anterior (front) portion and a lateral (side) portion so as to allow further contouring to the wearer's thigh and to allow the normal thigh muscle movements of contraction and relaxation without constriction or restriction.

3. In combination with claim 2, said thigh protector has openings in both the anterior portion and lateral portion through the foam covers and plastic core to allow ventilation of the underlying thigh.

4. In combination with claims 2 or 3, said ventilation openings are achieved by incorporating distinct mesh patterns within the molded plastic core and covering the plastic core mesh patterns with a corresponding pattern cut within the selected foam covers on either side of the core.

5. In accordance with claims 1 or 2 thigh pad protectors may be separated by appropriate means across the superior connection and the anterior portion used individually at the wearers discretion.

* * * * *